US005417063A

United States Patent [19]

Somers

[11] Patent Number: 5,417,063

[45] Date of Patent: May 23, 1995

[54] UNDERWATER HYDRAULIC SYSTEM FOR REDUCING PUMP NOISE

[75] Inventor: George W. Somers, Severna Park, Md.

[73] Assignee: Westinghouse Electric Corporation, Pittsburgh, Pa.

[21] Appl. No.: 232,907

[22] Filed: Apr. 25, 1994

[51] Int. Cl.[6] ..... F16D 31/00; F15B 21/04; B63C 11/46

[52] U.S. Cl. ..... 60/325; 60/415; 60/459; 91/4 R; 114/315; 440/5

[58] Field of Search ..... 91/4 R; 60/325, 415, 60/418, 408, 459; 114/315; 440/5, 111

[56] References Cited

U.S. PATENT DOCUMENTS

| | | | |
|---|---|---|---|
| 3,100,965 | 8/1963 | Blackburn | 91/4 R |
| 3,161,028 | 12/1964 | Odum et al. | 114/315 |
| 3,469,555 | 9/1969 | Greiner | 440/5 |
| 3,643,449 | 2/1972 | Murphy | 114/315 X |
| 4,539,814 | 9/1985 | McKie | 60/413 |

*Primary Examiner*—Edward K. Look
*Assistant Examiner*—Hoang Nguyen

[57] ABSTRACT

A hydraulic system which includes a pump for supplying hydraulic fluid to a load and receiving hydraulic fluid therefrom wherein the pump is acoustically isolated from the surrounding water medium. The pump and a motor which drives the pump is enclosed in a pressure vessel, the interior of which is supplied with a gas at a certain pressure less than the ambient water pressure. The pressure of the hydraulic fluid in the return line is maintained at a pressure less than the ambient by a reservoir arrangement which includes a piston and rod assembly with the rod being subject to the ambient water medium. A certain pressure within an oil filled compartment of the reservoir is maintained at a fraction of the ambient water medium pressure by making the ratio of the cross sectional area of the piston to the rod equal to that predetermined fraction. This reduced pressure compartment is hydraulically connected to the fluid return line as well as to a gas regulator.

7 Claims, 3 Drawing Sheets

UNDERWATER HYDRAULIC SYSTEM FOR REDUCING PUMP NOISE

BACKGROUND OF THE INVENTION

1. Field of the Invention

The invention in general relates to hydraulic fluid supplies, and more particularly to an arrangement used in the underwater environment wherein a pump supplies hydraulic fluid to a load.

2. Description of Related Art

Various underwater vehicles have hydraulically activated mechanisms which require the supply of a hydraulic fluid. The hydraulic fluid is supplied by a motor driven pump which has a supply line and a return line wherein the return line pressure is controlled by the ambient sea pressure and the supply pressure is a fixed differential pressure above the return pressure.

The pump may be carried on the outside of the vehicle or in a free flooded compartment within the vehicle and in order to reduce pump noise radiation to the surrounding water medium, and to protect the pump body and shaft seal from seeing an excessive differential pressure, a double enclosure acoustic isolation arrangement is provided.

In such arrangement, the pump/motor unit is placed within a first pressure vessel filled with hydraulic fluid at the return line pressure and this pressure vessel in turn is enclosed within a second and larger pressure vessel filled with a gas at a nominal pressure of one atmosphere.

Although radiated pump noise is significantly reduced, the arrangement is bulky, heavy and difficult to make and assemble.

The present invention accomplishes radiated pump noise reduction with a single pressure vessel thereby eliminating cost and significant complexity of a dual pressure vessel arrangement.

SUMMARY OF THE INVENTION

An improved hydraulic system is provided for use at an underwater structure such as an underwater vehicle wherein a pump supplies hydraulic fluid to a load. The arrangement includes a pressure vessel carried by the structure and exposed to the surrounding ambient water medium. A gas supply is provided for pressurizing the pressure vessel to some predetermined value. A motor driven pump is located within the pressure vessel and emanating from the pump is a hydraulic fluid supply line which connects the pump to the load with the hydraulic circuit being completed back to the pump by means of a hydraulic fluid return line. A means is provided which is connected to the hydraulic fluid return line for maintaining the fluid pressure within said return line at some predetermined fraction of the pressure of the ambient water medium. This is accomplished by means of a reservoir arrangement which includes a piston and rod assembly contained within a housing such that the piston divides the housing into first and second sections, with said rod being exposed to the ambient water pressure. The first section of the housing contains a hydraulic fluid while the second section contains a gas at a relatively low pressure. A fluid line connects the first section of the housing to the hydraulic fluid return line and the predetermined fractional pressure is obtained by making the axial cross-sectional area of the rod smaller than the axial cross-sectional area of the piston.

DESCRIPTION OF THE PREFERRED EMBODIMENTS

Figure 1:
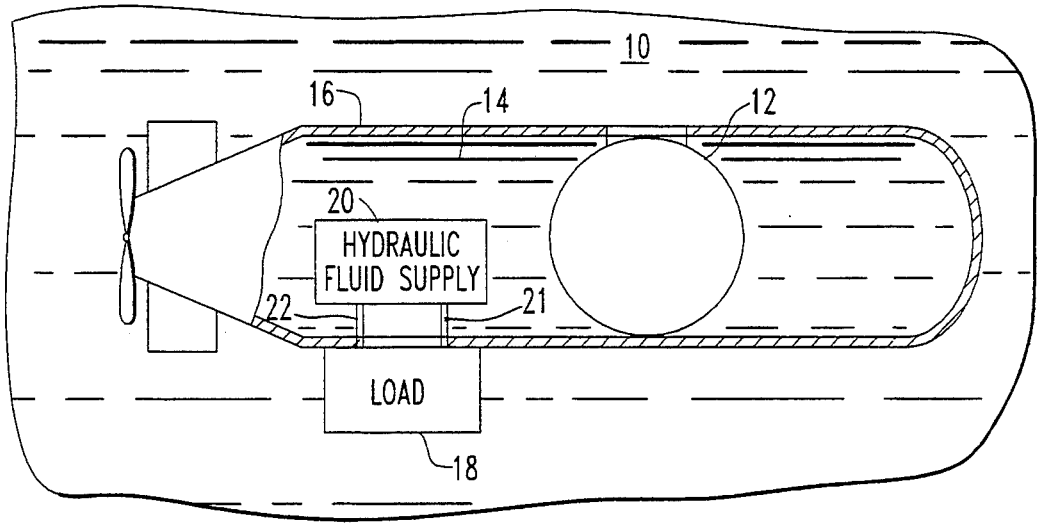
FIG. 1 is a view of an underwater vehicle in which the present invention finds application.

Although the invention is applicable with a variety of underwater structures, it will be described by way of example with respect to an underwater vehicle such as illustrated in FIG. 1. The underwater vehicle 10 includes a pressure hull 12 forming a one atmosphere compartment for a crew and surrounded by a free-flooded area 14 contained by the vehicle shell 16.

The vehicle carries a load 18 which may include valves and actuators for various mechanisms such as mechanical arms. The actuators are hydraulically operated and accordingly a hydraulic fluid supply 20 within the free-flooded area 14 supplies hydraulic fluid to the load by means of a supply line 21 and hydraulic fluid is returned from the load by means of return line 22. The hydraulic fluid supply includes a motor driven pump, the radiated noise from which must be minimized.

Figure 2:
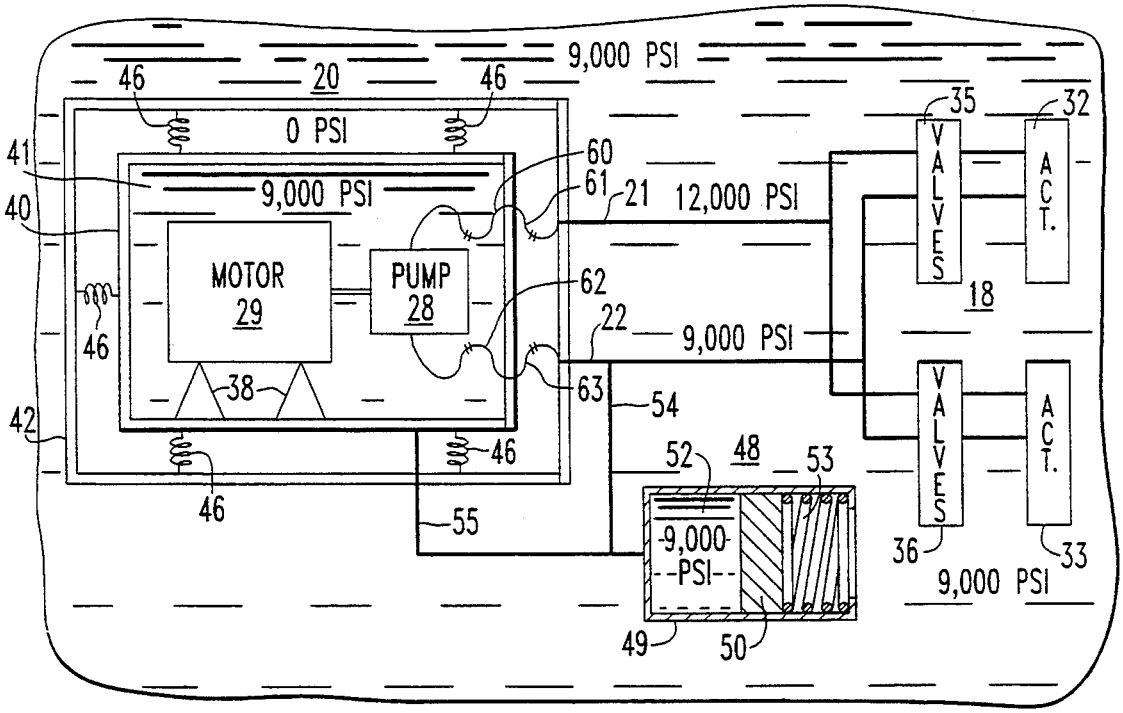
FIG. 2 PRIOR ART
FIG. 2 is a schematic diagram of a hydraulic supply system of the prior art.

FIG. 2 schematically illustrates a known arrangement which is utilized for minimizing pump noise. For simplicity, conventional filters, accumulators, silencers, etc. have not been illustrated. A pump 28, coupled to and driven by motor 29, supplies hydraulic fluid to the load 18 which may include a plurality of actuators of which two, 32 and 33 are illustrated. Actuator selection and direction of movement are governed by respective valves 35 and 36 which may be activated by electrical signals provided by an onboard command.

The motor 29 is situated on mounts 38 and the motor, along with pump 28 is positioned within a first or inner pressure vessel 40 filled with hydraulic fluid The first pressure vessel 40 is, in turn, contained within a second or outer pressure vessel 42 which includes a gas that is at substantially atmospheric pressure, with the gas forming an acoustic impedance mismatch to minimize pump noise radiated into the surrounding ambient medium. Transmission of vibration and noise is also reduced with the provision of shock isolation mounts 46.

A hydraulic reservoir 48 accommodates changes in system volume and maintains the return line pressure as well as the pressure of the fluid within vessel 40 at a certain value which is substantially equal to the pressure of the ambient medium.

The reservoir includes a housing 49 having a movable piston 50 therein to thereby define compartment 52 which is filled with hydraulic oil. The other side of the piston is exposed to the ambient seawater pressure and if desired, the piston may be biased by means of a spring to insure that if there is a leak, the hydraulic oil will leak out as opposed to seawater leaking in. Compartment 52 is in pressure communication with return line 22 by means of a first fluid line 54 and is in pressure communication with the interior of pressure vessel 40 by means of second fluid line 55.

The hydraulic fluid supply line 21 is connected to the output side of pump 28 by fluid supply lines 60 and 61 both of which must be flexible to accommodate opening and closing of the pressure vessels. In a similar manner the return line 22 is connected to the pump inlet by means of respective fluid lines 62 and 63.

Figure 3:
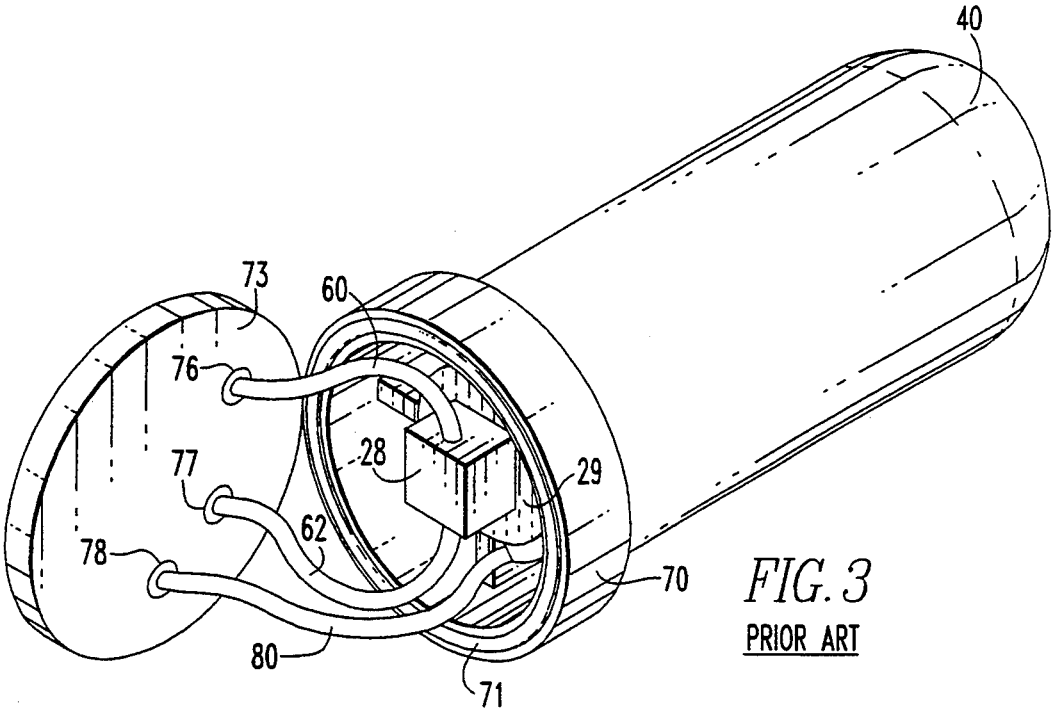
FIG. 3 PRIOR ART
FIGS. 3 and 4 are diagrammatic views of the apparatus of FIG. 2.

The hydraulic supply arrangement illustrated in FIG. 2 is extremely bulky, heavy, difficult to implement and requires numerous high pressure seals since both pressure vessels are subjected to a maximum pressure differential equivalent to the ambient pressure at depth. With additional reference to FIG. 3, there is illustrated a typical inner pressure vessel 40 which includes the pump 28 and motor 29. The end of pressure vessel 40 includes a flange 70 which has an o-ring seal 71 therein and which accommodates a cover plate 73 which is fastened thereto by means such as clamps or bolts (not illustrated).

Fluid lines 60 and 62 are connected to respective high pressure fittings 76 and 77 in the cover which also accommodates a high pressure electrical penetrator 78 for connection to electrical wires 80 which supply electrical energy to motor 29.

Figure 4:
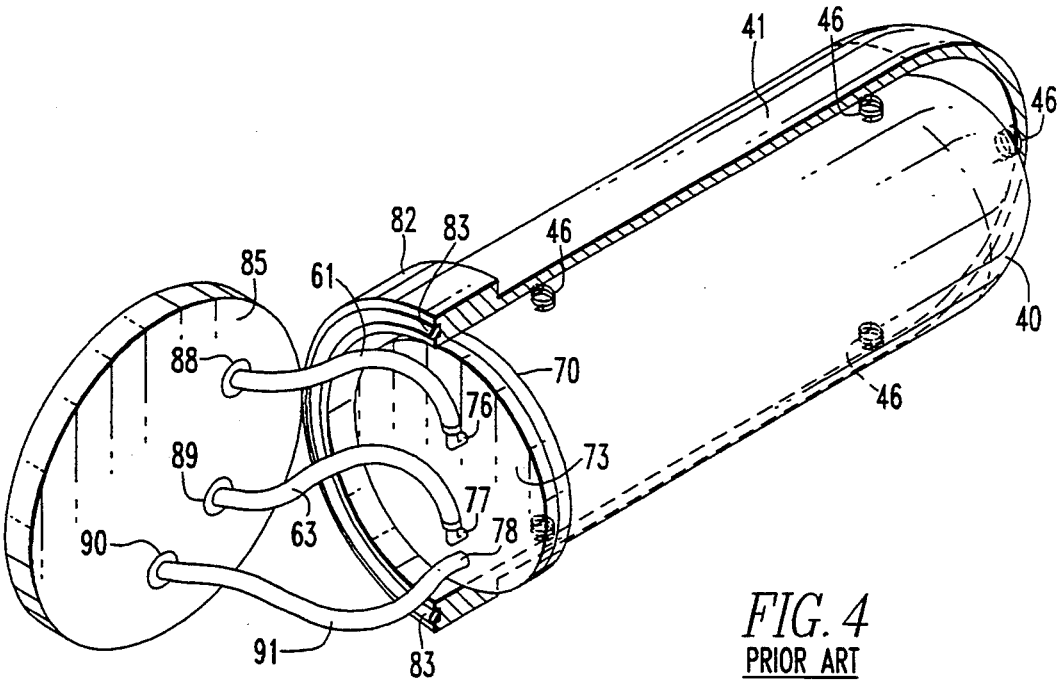
FIG. 4 PRIOR ART

In FIG. 4, the first pressure vessel 40 is illustrated in position within second pressure vessel 41 and spaced therefrom by means of isolation amounts 46. Pressure vessel 41 includes a flange 82 having an o-ring seal 83 for engagement with cover plate 85.

Cover plate 85, which may be bolted or clamped to flange 82 includes high pressure gas fittings 88 and 89 to which are connected the flexible fluid lines 61 and 63 and additionally includes high pressure electrical penetrator 90 for electrical wires 91 connected to the previous electrical penetrator 78 in cover plate 73 of pressure vessel 40. In addition to the high pressure fittings illustrated, two additional high pressure fittings (not illustrated) will have to be provided to accommodate the fluid line 55 which communicates the interior of pressure vessel 40 with compartment 52 of reservoir 48.

The present invention is particularly well adapted for use at depths in the order of 20,000 feet. With reference once again to FIG. 2, various pressures are illustrated in the drawing by way of example for an operational depth where the ambient water pressure is 9,000 psi (approximately 20,270 feet in seawater). The negligible effect of the bias spring 53 has been omitted and therefore compartment 52 illustrates a pressure of 9,000 psi equivalent to the ambient water pressure. This is the same pressure as in the return line 22 and in the interior of the first pressure vessel 40. Pump 28 is a commercially available off the shelf pump which delivers hydraulic fluid at a pressure equivalent to 3,000 psi above inlet supply, and consequently the pressure of the fluid in supply line 21 is 12,000 psi.

The interior of the second pressure vessel 42 is at a pressure of zero psi and consequently pressure vessel 42, as well as pressure vessel 40 must withstand a pressure differential of 9,000 psi and hose 61 and fittings 76 and 88 (FIG. 4) must withstand a pressure difference of 12,000 psi.

With the present invention, only a single pressure vessel is utilized for housing the motor/pump arrangement thereby eliminating weight, bulk and complexity as well as reducing the number of high pressure fittings and connectors required. In addition, for the same depth capability, the pressure vessel is subjected to less of a pressure differential.

Figure 5:
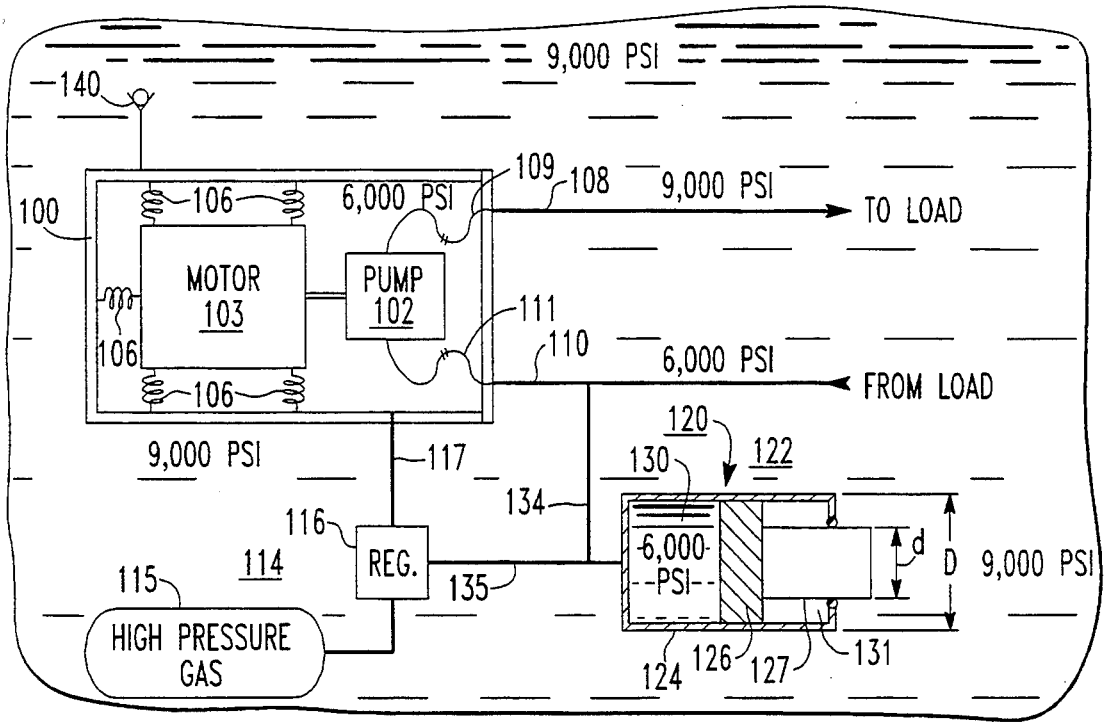
FIG. 5 is a schematic of a hydraulic system in accordance with the present invention.

Referring now to FIG. 5 illustrating one embodiment of the present invention, the apparatus includes a single pressure vessel 100 containing the pump 102 driven by motor 103 carried by shock isolation mounts 106. The pump 102 supplies hydraulic fluid to hydraulic fluid supply line 108 via a single flexible fluid line 109 and the high pressure fluid is supplied to the load (not shown). Fluid return is accommodated by hydraulic fluid return line 110 connecting to the input of pump 102 by means of flexible fluid line 111.

A gas supply 114 is provided for pressurizing the interior of vessel 100 to a predetermined value, as will be described. The gas supply includes a source of high pressure gas 115 and a pressure regulator 116 connected to the interior of pressure vessel 100 by means of a gas line 117.

Means 120 are provided for maintaining the pressure of the fluid within return line 110 at a predetermined fraction of the pressure of the ambient water medium. This is accomplished by means of a reservoir 122 which includes a housing 124 containing a piston and rod assembly comprised of piston 126 and rod 127 with the piston dividing the housing 124 into a first compartment 130 containing hydraulic fluid, and second compartment 131 containing a gas at relatively low pressure, for example 15–100 psi so that its effect on the return line pressure is negligible.

A first fluid line 134 connects compartment 130 with the return line 110 and a second fluid line 135 operating as a sensing line functions, in conjunction with regulator 116 to maintain the gas pressure supplied to pressure vessel 100 equal to the return line pressure.

Figure 6:
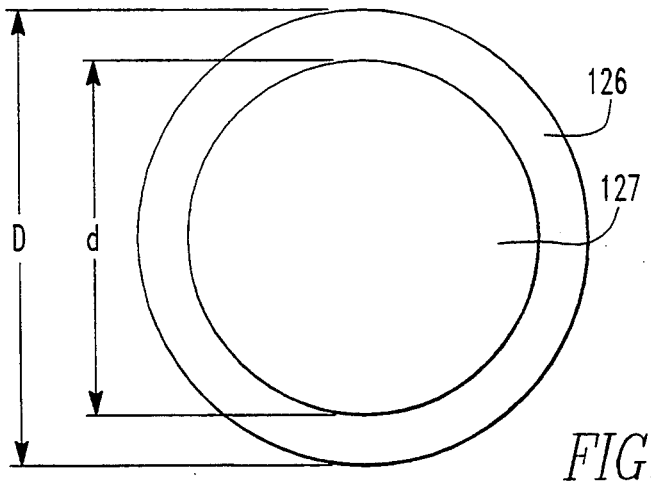
FIG. 6 is an end view of a portion of the apparatus used in the reservoir of FIG. 5.

The pressurization of the return line (as well as the interior of vessel 100) to a value which is a fraction of the ambient water pressure is accomplished by the design of the piston and rod assembly. By way of example, let it be assumed that the piston and rod are circular cylinders having respective diameters of "d" for rod 127 and "D" for piston 126 as additionally illustrated in FIG. 6 showing an end view of the assembly. The diameters are so selected such that the ratio of the axial cross sectional areas of the rod to piston is the predetermined fraction desired. If the cross sectional area of rod 127 is "a" and that of piston 126 is "A" and if the system is to be pressurized to a value of $\frac{2}{3}$ of the ambient water pressure, then:

$$\frac{a}{A} = \frac{2}{3}$$

The area on which the ambient water pressure acts is $\frac{2}{3}$ of the area on which the hydraulic pressure acts thus controlling the return line pressure.

For a depth as previously described by way of example where the ambient pressure is 9,000 psi, with an a-to-A ratio of $\frac{2}{3}$, the pressure of hydraulic fluid within first compartment 130 is 6,000 psi as is the return line pressure. The pressure in compartment 130 is communicated to regulator 116 such that the interior of pressure vessel 100 is maintained at a value of 6,000 psi resulting in a pressure differential across the walls of the pressure vessel of 3,000 psi as opposed to 9,000 psi as was the case with respect to the prior art apparatus of FIG. 2.

The pump supply pressure is 3,000 over that of the return and accordingly hydraulic fluid in supply line 108 is at a pressure of 9,000 psi. As the apparatus ascends from the deep water depths, the ambient water pressure decreases. Accordingly, a vent 140 is connected to the interior of pressure vessel 100 in order to relieve the pressure therein as the pressure values reduce.

In general, in the design of the apparatus, the pump supply pressure is made equal to the ambient pressure at maximum depth. The return pressure at the pump inlet is set at 3000 psi below the supply pressure and the ratio of rod to piston area, a/A, is then selected to accomplish this.

For a maximum operating depth of 20270 feet, previously described, the ambient pressure is 9000 psi, the pump supply pressure is 9000 psi, the return pressure is 6000 psi and the ratio of a/A is $\frac{2}{3}$.

By way of further example, for a maximum operating depth of 10135 feet, the ambient pressure is 4500 psi, the pump supply pressure would be 4500 psi, the return pressure 1500 psi and the ratio of a/A would be 1500/4500 or $\frac{1}{3}$.

Accordingly, the improved hydraulic circuit described operates at pressures at and below the ambient water pressure and achieves the acoustic isolation of the prior art system of FIG. 2 with far less complexity and fewer components. In addition, it is known that the viscosity of the hydraulic fluid increases with pressure, and elastomers used for seals become stiffer. Both of these effects are reduced with the present arrangement since the maximum pressure is reduced from 12,000 psi to 9,000 psi.

I claim:

1. A hydraulic system for use in an underwater structure wherein hydraulic fluid is supplied to a load, comprising:

A) a pressure vessel carried by said structure and exposed to the surrounding ambient water medium and including a pressurized gas therein;

B) a gas supply for pressurizing said pressure vessel;

C) a pump and drive motor therefor contained within said pressure vessel;

D) a hydraulic fluid supply line connecting said pump to said load;

E) a hydraulic fluid return line connecting said load back to said pump; and

F) means connected to said hydraulic fluid return line for maintaining the fluid pressure therein at a predetermined fraction of the pressure of the ambient water medium, where said predetermined fraction is less than 1.

2. Apparatus according to claim 1 wherein said means includes:

A) a piston and rod assembly;

B) a housing containing said assembly in a manner that said piston divides said housing into first and second compartments and said rod is exposed to the ambient water pressure;

C) said first compartment containing a hydraulic fluid and said second compartment containing a gas at a relatively low pressure;

D) a first fluid line connecting said first compartment with said hydraulic fluid return line;

E) the axial cross sectional area "a" of said rod being smaller than the axial cross sectional area of "A" of said piston.

3. Apparatus according to claim 2 wherein:

A) the ratio of a/A is equal to said predetermined fraction.

4. Apparatus according to claim 2 wherein:

A) said piston is cylindrical.

5. Apparatus according to claim 2 wherein:

A) said rod is cylindrical.

6. Apparatus according to claim 1 wherein said gas supply includes:

A) a gas container;

B) a regulator for supplying the gas within said container to said pressure vessel at a certain pressure; and C) means for communicating the hydraulic fluid return line pressure to said regulator for delivering gas to said pressure vessel at said return line pressure.

7. Apparatus according to claim 6 wherein the means for communicating the return line pressure includes:

A) a second fluid line connected to said first fluid line.

* * * * *